US007159802B2

(12) United States Patent
Oomura et al.

(10) Patent No.: US 7,159,802 B2
(45) Date of Patent: Jan. 9, 2007

(54) FLUID INJECTION NOZZLE, FUEL INJECTOR HAVING THE SAME AND MANUFACTURING METHOD OF THE SAME

(75) Inventors: Hidekazu Oomura, Hekinan (JP); Yoshinori Yamashita, Kariya (JP); Yukio Tomiita, Anjo (JP); Yukio Sawada, Kariya (JP); Ryo Nagasaka, Nagoya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/195,609

(22) Filed: Aug. 3, 2005

(65) Prior Publication Data

US 2006/0049286 A1 Mar. 9, 2006

(30) Foreign Application Priority Data

Aug. 17, 2004 (JP) ..... 2004-237307

(51) Int. Cl.
*B05B 1/00* (2006.01)

(52) U.S. Cl. ..... 239/596; 239/533.12; 239/585.1; 239/597; 239/598; 239/599

(58) Field of Classification Search ..... 239/494, 239/497, 499, 533.12, 552, 584, 585.1, 596, 239/597, 598, 599, 601
See application file for complete search history.

(56) References Cited

U.S. PATENT DOCUMENTS

| | | | | |
|---|---|---|---|---|
| 5,383,597 | A * | 1/1995 | Sooriakumar et al. | 239/5 |
| 5,553,790 | A * | 9/1996 | Findler et al. | 239/585.1 |
| 6,318,641 | B1 * | 11/2001 | Knebel et al. | 239/5 |
| 6,405,946 | B1 | 6/2002 | Harata et al. | 239/533.12 |
| 6,439,484 | B1 * | 8/2002 | Harata et al. | 239/596 |
| 6,616,072 | B1 | 9/2003 | Harata et al. | 239/533.12 |
| 6,644,565 | B1 * | 11/2003 | Hockenberger | 239/533.2 |
| 2004/0124279 | A1 | 7/2004 | Harata et al. | 239/533.12 |
| 2004/0178286 | A1 * | 9/2004 | Takeda et al. | 239/463 |

* cited by examiner

*Primary Examiner*—Jason Boeckmann
(74) *Attorney, Agent, or Firm*—Nixon & Vanderhye PC

(57) ABSTRACT

A fluid injection nozzle has an injection port plate, an injection port and a protruding portion. The injection port plate is to be mounted on a downstream end of a fluid injection valve so that a center axis thereof is coaxial to the fluid injection valve. The injection port penetrates the injection port plate between an inlet and an outlet. The protruding portion protrudes from an inner surface of the injection port to shift a direction of at least a part of a fluid flow passing through the injection port to flow in a circumferential direction of the inner surface.

10 Claims, 19 Drawing Sheets

FLUID INJECTION NOZZLE, FUEL INJECTOR HAVING THE SAME AND MANUFACTURING METHOD OF THE SAME

CROSS REFERENCE TO RELATED APPLICATION

This application is based on Japanese Patent Application No. 2004-237307 filed on Aug. 17, 2004, the content of which is incorporated herein by reference.

FIELD OF THE INVENTION

The present invention relates to a fluid injection nozzle, a fuel injector having the fluid injection nozzle and a manufacturing method of the fluid injection nozzle, especially relates to them suitable for injecting fuel into cylinders of internal combustion engine (hereinafter referred to just as "engine").

BACKGROUND OF THE INVENTION

U.S. Pat. No. 6,616,072-B2 and its counterpart JP-2001-317431-A disclose a fuel injector provided with an injection port plate at fuel downstream end of a valve body. The injection port plate has an injection port. A valve member lifts up and down to inject fuel through the injection ports intermittently. In such an injection port plate having an injection port injector, it is often necessary to atomize the liquid such as fuel to be injected through the injection ports.

It is possible to atomize the injected liquid effectively by flowing the liquid in a circumferential direction on an inner surface of the injection port. In U.S. Pat. No. 6,616,072-B2, the injection port extends to be inclined to a thickness direction of the injection port plate and a diameter of the injection port gradually increases as it comes closer to the downstream side so as to flow the liquid in the circumferential direction on the inner surface of the injection port.

However, the structure disclosed in U.S. Pat. No. 6,616,072-B2 does not operate enough to flow the liquid in the circumferential direction on the inner surface of the injection port to atomize the injected liquid sufficiently.

SUMMARY OF THE INVENTION

The present invention, in view of the above-described issue, has an object to provide a fluid injection nozzle, a fuel injector having the fluid injection nozzle and a manufacturing method of the fluid injection nozzle capable of atomizing the injected liquid sufficiently.

The fluid injection nozzle has an injection port plate, an injection port and a protruding portion. The injection port plate is to be mounted on a downstream end of a fluid injection valve so that a center axis thereof is coaxial to the fluid injection valve. The injection port penetrates the injection port plate between an inlet and an outlet. The protruding portion protrudes from an inner surface of the injection port to shift a direction of at least a part of a fluid flow passing through the injection port to flow in a circumferential direction of the inner surface.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Embodiments of a fluid injection nozzle, a fuel injector having the fluid injection nozzle and a manufacturing method of the fluid injection nozzle according to the present invention will be described in detail in the following. Each the fluid injection nozzle according to the following embodiments is incorporated in the fuel injector for a gasoline engine.

(First Embodiment)

Figure 3:
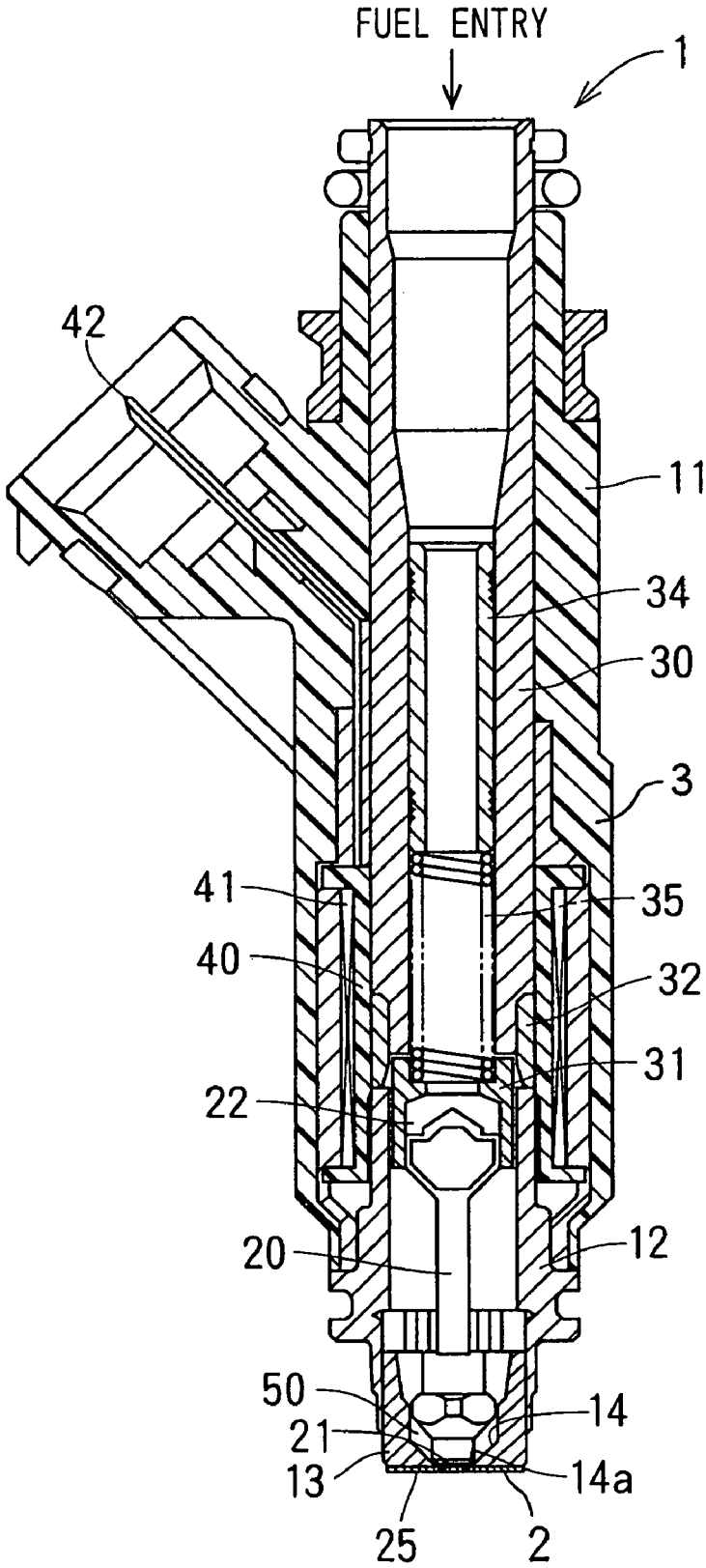
FIG. 3 is a cross-sectional view showing the fuel injector according to the first embodiment.

FIG. 3 depicts a fuel injector 1 that has a fluid injection nozzle 2 according to a first embodiment of the present invention. The fuel injector 1 has a casing (valve body portion) 11 made of molded resin and covering a (valve body portion) magnetic pipe 12, a stator core 30, a coil 41 wound on a spool 40, and so on. A valve body (valve body portion) 13 is jointed to the magnetic pipe 12 by laser welding or the like. A nozzle needle 20 as a valve member is installed in the magnetic pipe 12 and the valve body 13 to be reciprocally movable therein. The nozzle body 20 is provided with an abutment portion 21 for seating on a valve seat 14*a* formed on an inner surface 14 of the valve body 13. The inner surface 14 is formed in a conical shape on an inner circumference wall of the valve body 13 to form a fuel passage 50 as a fluid passage. The inner surface 14 is converged toward a fuel downstream side.

Figure 2:
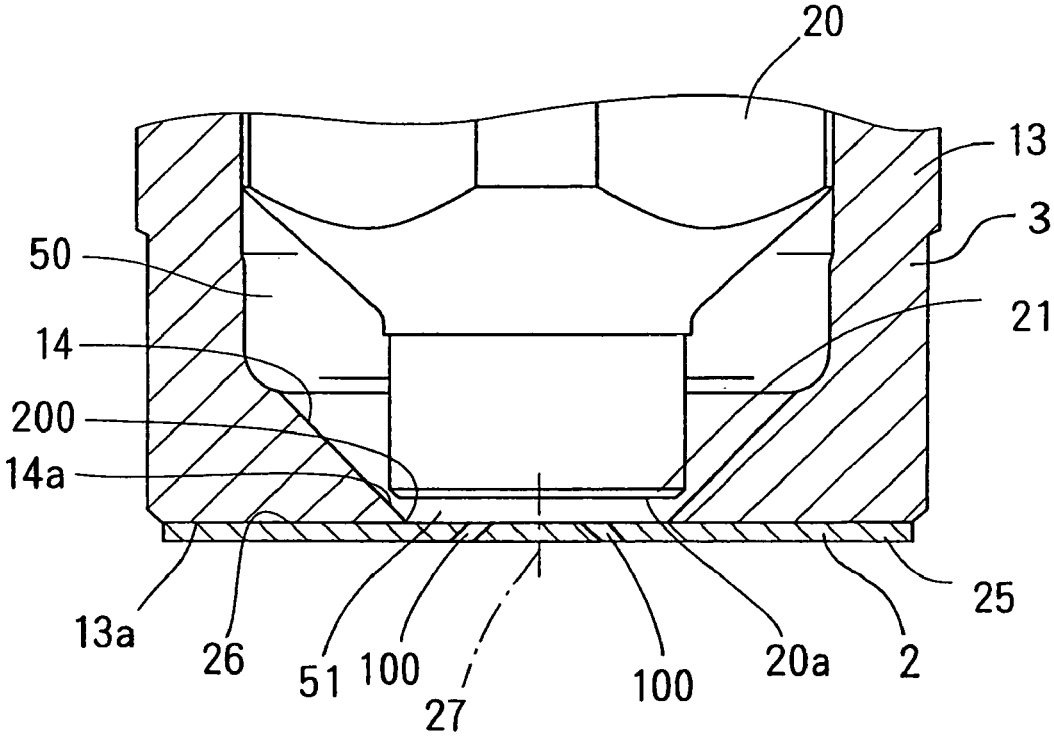
FIG. 2 is an enlarged cross-sectional view showing a nozzle portion of a fuel injector having the fuel injection nozzle according to the first embodiment.

As shown in FIG. 2, a leading end face 20*a* of the nozzle needle 20 has an approximately flat shape. A fuel chamber 51 as a fluid chamber is partitioned by the leading end face 20*a* of the nozzle needle 20, a fuel inlet side end face 26 of the injection port plate 25 and the inner surface 14 to be a flat and approximately disc-shaped space.

As shown in FIG. 3, a joint portion 22 is disposed at on a counter abutment portion 21-side of the nozzle needle 20 and jointed to a moving core 31. A stator core 30 is jointed to a non-magnetic pipe 32 and the non-magnetic pipe 32 is jointed to the magnetic pipe 12 respectively by laser welding or the like.

As shown in FIG. 2, the injection port plate 25 is arranged on a fuel downstream side end face 13*a* of the valve body 13. The injection port plate 25 has a thin disc shape. FIG. 2 depicts a cross-section that is taken along such a cranked plane as to show the sectional shapes of injection ports 100.

The injection port plate 25 is laser-welded to the valve body 13 so as to abut against the end face 13*a* of the valve body 13. The injection port plate 25 is provided with a plurality of injection ports 100, which are disposed around a center axis 27 extending along a thickness direction of the injection port plate 25.

Figure 1A:
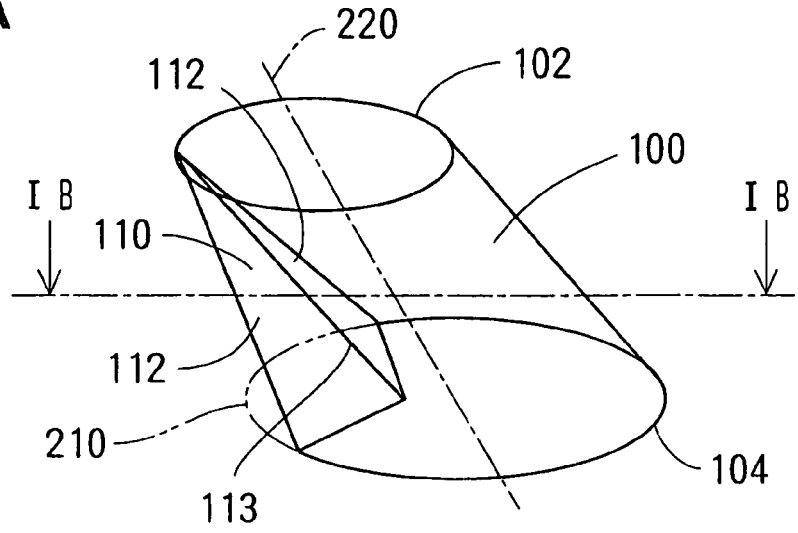
FIG. 1A is schematic perspective view of a fluid injection nozzle according to a first embodiment of the present invention.

The injection port 100 is disposed inside a circle line 200 of an intersection of the inner surface 14 and an upper face 26 of the injection port plate 25. The injection port 100 is inclined to the center axis 27 of the injection port plate 25 so as to extend radially outward from an inlet 102 to an outlet 104 thereof. As shown in FIG. 1A, a diameter of the outlet 104 is larger than that of the inlet 102. That is, a diameter of the injection port 100 becomes larger as going from the inlet 102 to the outlet 104.

Figure 1B:
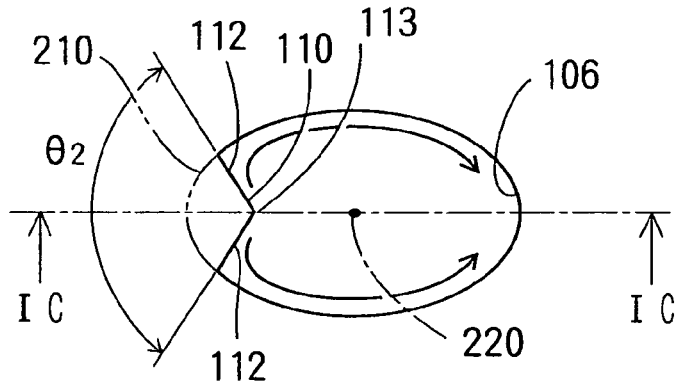
FIG. 1B is a cross-sectional view showing the fluid injection nozzle of FIG. 1A taken along a line IB—IB.
Figure 1C:
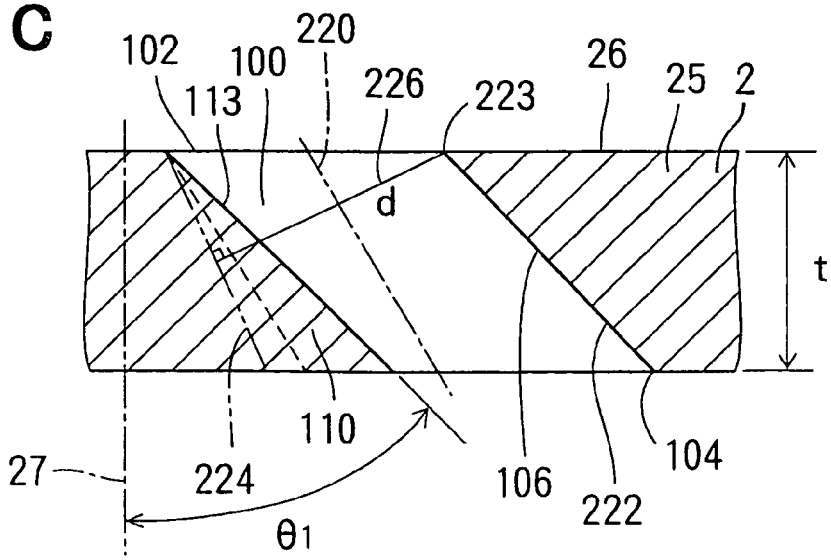
FIG. 1C is another cross-sectional view showing the fluid injection nozzle of FIG. 1A taken along a line IC—IC in FIG. 1B.

As shown in FIGS. 1A to 1C, the injection port 100 has an inner surface 106 provided with a protruding portion 110 that is disposed at a center axis 27-side thereof. That is, the protruding portion 110 is disposed at the center axis 27-side on which a fuel flowing through the injection port 100 is condensed. The protruding portion 110 is included to the center axis 27 so as to extend radially outward from the inlet 102 to the outlet 104 of the injection port 100.

The protruding portion 110 has flat-shaped two side faces 112. As shown in FIG. 1B, the side faces 122 form an angle $\theta_2$ with each other on an imaginary plane in parallel to the injection port plate 25 so that the angle $\theta_2$ is larger than 0 degree and smaller than 180 degrees. That is, the protruding portion 110 protrudes radially inward in the injection port 100. The two side faces 112 have approximately the same area as each other. A width of each the side faces 122 increases from the inlet 102 to the outlet 104 of the injection port 100. At the inlet 102, the injection port 100 has an approximately oval shaped cross-section, which is taken in a direction perpendicular to the center axis 27 of the injection port plate 25. Except for the inlet 102, the injection port 100 has a cross-section, including the inner surface 106 on an imaginary oval line 210 and the side faces 112 inside the imaginary oval line 210. The imaginary oval lime 210 may include a perfect circle.

As shown in FIG. 1C, a ridge line 113, on which the two side faces 112 intersect, and the center axis 27 form an angle $\theta_1$ with each other. The angle $\theta_1$ is larger than 0 degree and smaller than 90 degrees.

As shown in FIG. 3, a spring 35 is disposed on the fuel downstream side of the adjusting pipe 34 to urge the nozzle needle 20 toward the valve seat 14*a*. An urging force of the spring 35 is modified by adjusting the position of the adjusting pipe 34 in an axial direction thereof.

A coil 41, as wound on the spool 40, is so positioned in the casing 11 as to cover a lower end portion of the stator core 30 and an upper end portion of the magnetic pipe 12, which are disposed to interpose a non-magnetic pipe 32 therebetween, and an outer circumference of the non-magnetic pipe 32. The coil 41 is electrically connected with a terminal 42 so as to supply driving electric power from the terminal 42 to the coil 41.

Figure 4A:
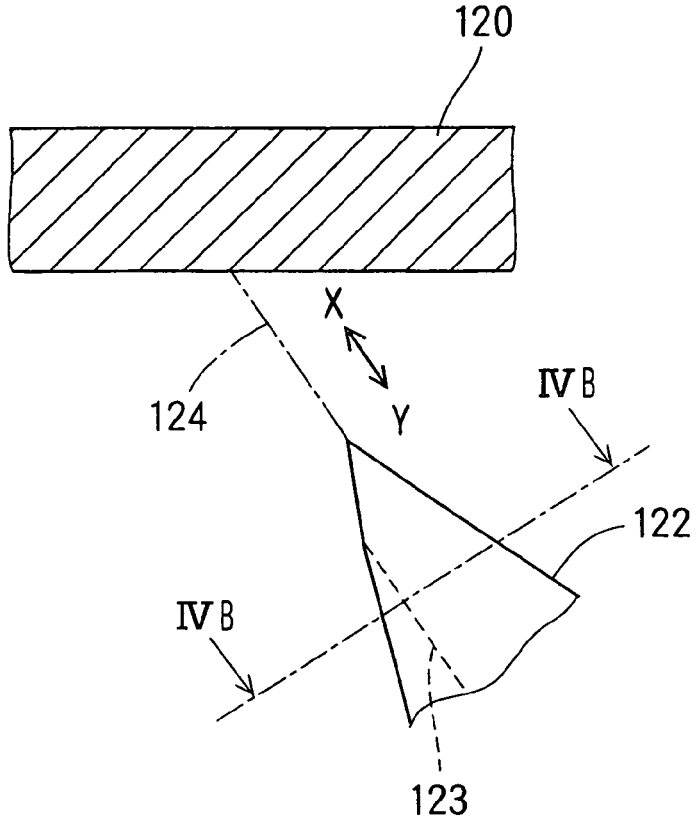
FIG. 4A is a schematic cross-sectional view showing a first manufacturing method of the fluid injection nozzle according to the first embodiment.
Figure 4B:
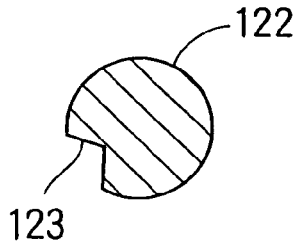
FIG. 4B is a cross-sectional view showing a punch in FIG. 4A taken along a line IVB—IVB.

A manufacturing method of the injection port plate 25 will be described in the following. As shown in FIG. 4A, a plate-shaped base material 120 of the injection port plate 25 is punched with a punch 122 so as to be the fuel injection plate 25 shown in FIG. 4C. As shown in FIGS. 4A and 4B, the punch 122 has a conical shape a part of which has a notch 123.

Figure 4C:
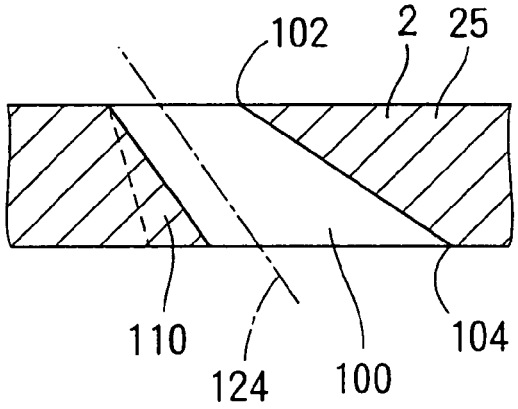
FIG. 4C is a cross-sectional view showing the fluid injection nozzle formed by the first manufacturing method according to the first embodiment.

FIGS. 5A to 5C and 6A to 6E depict a second manufacturing method of the injection port plate 25 other than the above-described manufacturing method shown in FIGS. 4A to 4C.

(1) First Process

Figure 5A:
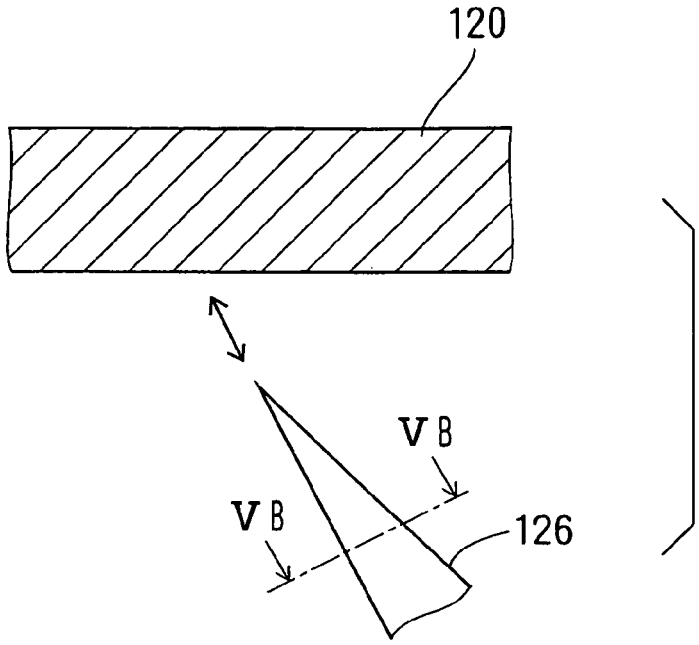
FIG. 5A is a schematic cross-sectional view showing a first process of a second manufacturing method of the fluid injection nozzle according to the first embodiment.
Figure 5B:
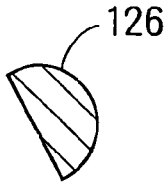
FIG. 5B is a cross-sectional view of a punch in FIG. 5A taken along a line VB—VB.
Figure 5C:
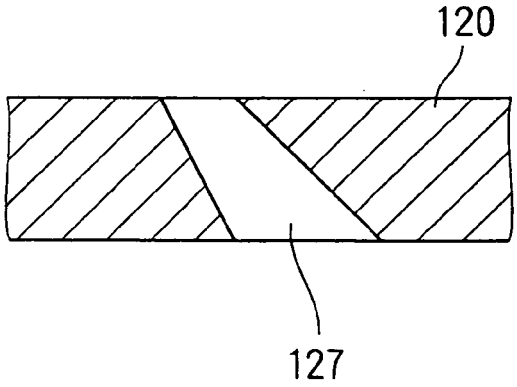
FIG. 5C is a cross-sectional view showing a provisional hole formed by the first process of the second manufacturing method according to the first embodiment.

Firstly, as shown in FIG. 5A, a base material plate 120 of the injection port plate 25 is stamped with a punch 126 having a semicircular shaped cross-section as shown in FIG. 5B from one side face of the base material plate 120. Thus, as shown in FIG. 5C, a provisional hole 127 is formed in the base material plate 120 that has a semicircular shaped cross-section.

(2) Second Process

Figure 6A:
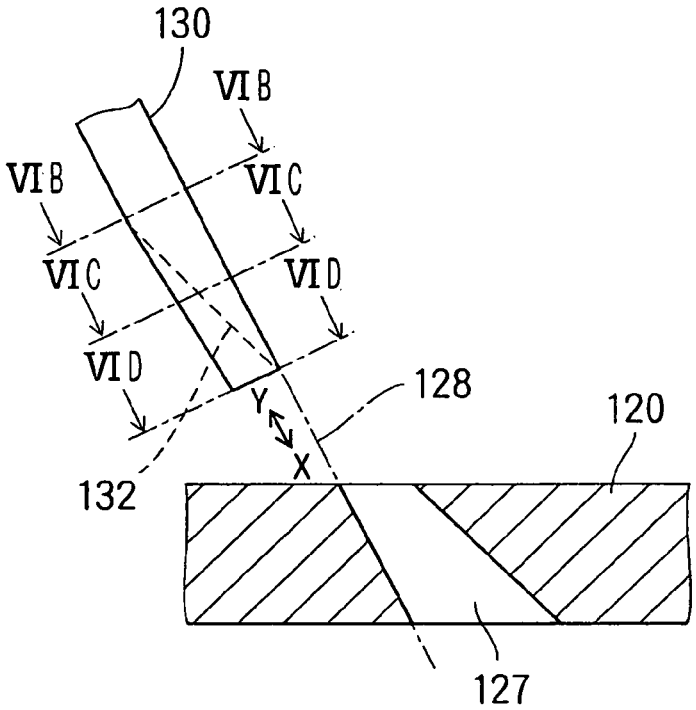
FIG. 6A is a schematic cross-sectional view showing a second process of the second manufacturing method of the fluid injection nozzle according to the first embodiment.
Figure 6B:
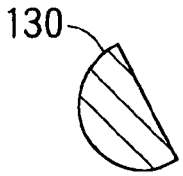
FIG. 6B is a cross-sectional view of a punch in FIG. 6A taken along a line VIB—VIB.
Figure 6C:
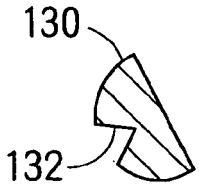
FIG. 6C is a cross-sectional view of the punch in FIG. 6A taken along a line VIC—VIC.
Figure 6D:
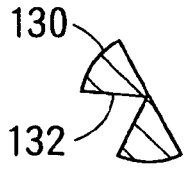
FIG. 6D is a cross-sectional view of the punch in FIG. 6A taken along a line VID—VID.
Figure 6E:
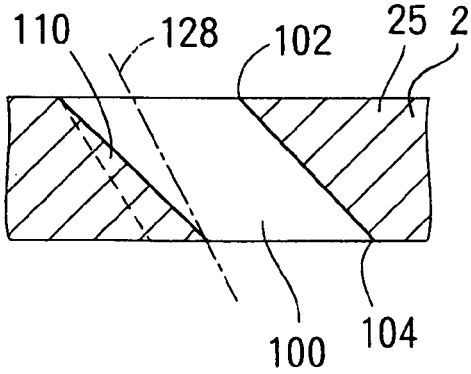
FIG. 6E is a cross-sectional view showing the fluid injection nozzle formed by the second process of the second manufacturing method according to the first embodiment.

Next, as shown in FIG. 6A, the base material plate 120 is stamped with a punch 130 having a notch 132, which is shaped in accordance with a shape of the protruding portion 110 as shown in FIGS. 6B to 6D, from another side face of the base material plate 120. Thus, the injection port 100 is formed in the base material plate 120 to be the injection port plate 25 shown in FIG. 6E.

According to the second manufacturing method shown in FIGS. 5A to 5C and 6A to 6E, the protruding portion 110 is formed so that the side faces 112 thereof is in parallel to a processing axis 128 or approaches the processing axis 128 as it comes closer to the outlet 104. The processing axis is along the processing direction 128. In the first embodiment, the diameter of the injection port 100 increases as it comes closer to the outlet 104. Thus, the side faces 112 of the protruding portion 110 is in parallel to a processing axis 128 or approaches the processing axis 128 as it comes closer to the outlet 104.

An operation of the fuel injector 1 will be described in the following.

(1) While the power to the coil 41 is OFF, the moving core 31 and the nozzle needle 20 are moved toward the valve seat 14*a* by the biasing force of the spring 35 so that the abutment portion 21 is seated on the valve seat 14*a*. Therefore, the fuel passage 50 is shut so that the fuel is not injected from the individual injection ports 100.

(2) When the power to the coil 41 is ON, there is generated in the coil 41 an electromagnetic attracting force which can attract the movable iron core 31 toward the stator core 30. When the moving core 31 is attracted toward the stator core 30 by that electromagnetic attracting force, the nozzle needle 20 is moved toward the stator core 30 so that the abutment portion 21 leaves the valve seat 14*a*. As a result, the fuel flows from the open portion between the abutment portion 21 and the valve seat 14*a* into the fuel chamber 51. Thus, the fuel having flown into the fuel chamber 51 goes into the injection port 100.

As shown in FIG. 1B, the protruding portion 110 shifts the fuel flowing from the inlet 102 into the injection port 100 to flow in a circumferential direction of the inner surface 106. A cross-sectional area of the injection port 100 gradually increases as it comes closer to the outlet 104 except for the protruding portion 110, so that the fuel expands in flowing along the inner surface 106 of the injection port 100 toward the outlet 104. Thus, fuel liquid film becomes thin and uniform when it is injected out of the injection port 100 to be sufficiently atomized.

In the first embodiment, the injection port 100 is specified as $0.4 \leqq t/d \leqq 1.2$, wherein d denotes a diameter of the inlet 102 of the injection port 100, and t denotes a thickness of the injection port plate 25. The diameter d of the inlet 102 is determined as follows. As shown in FIG. 1C, assuming that the injection port 100 has no protruding portion 110, the inner surface 106 intersects an imaginary plane, which is perpendicular to the injection port plate 25 and includes both center points of the inlet 102 and outlet 104, on two intersection lines 222, 224. One 222 of the intersection lines 222, 224, which forms an acute angle with an inlet 102-side face 26 of the injection port plate 25, intersects with the inlet-side face 26 at an intersection point 223. The diameter d is a distance from the intersection point 223 to the other 224 of the intersection lines 222, 224.

When t/d<0.4 in the injection port plate 25 according to the first embodiment, the injection port 100 injects fuel in unstably fluctuating directions. When t/d>1.4, fuel passing through the injection port 100 flocculates to spoil uniform and thin film-shaped fuel injection and to obstruct atomization of fuel spray. Accordingly, by keeping a relation of $0.4 \leqq Vd \leqq 1.2$, it is possible to inject fuel in a preferable direction and to atomize fuel spray efficiently.

In each the following embodiments, the protruding portion shifts the fuel flowing into the inlet to flow along the inner surface in the circumferential direction of the injection port.

(Second, Third and Fourth Embodiments)

Figure 7A:
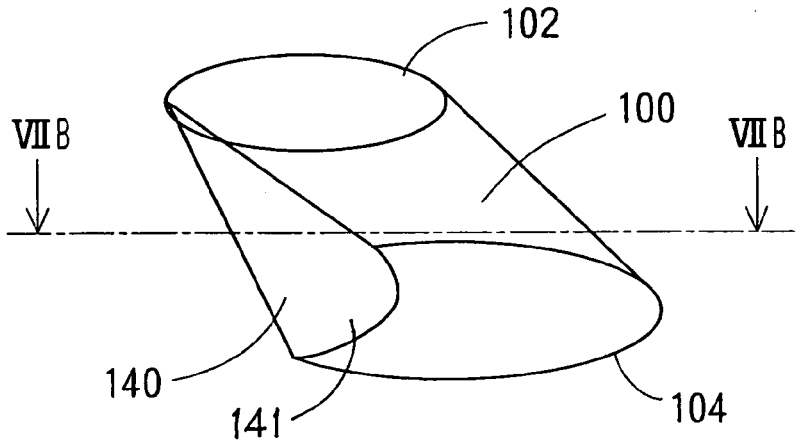
FIG. 7A is schematic perspective view of a fluid injection nozzle according to a second embodiment of the present invention.
Figure 7B:
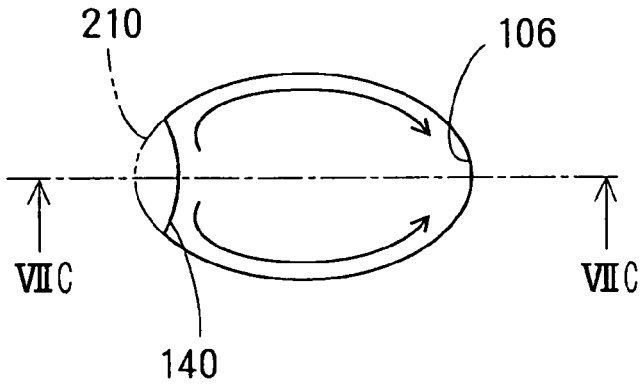
FIG. 7B is a cross-sectional view showing the fluid injection nozzle of FIG. 7A taken along a line VIIB—VIIB.
Figure 7C:
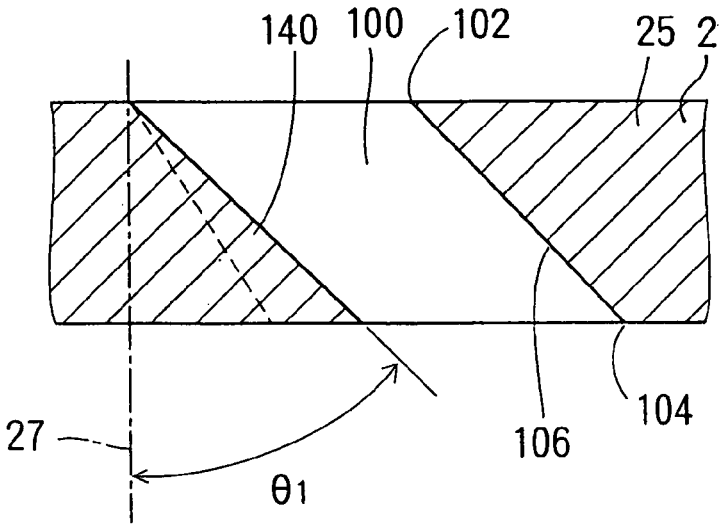
FIG. 7C is another cross-sectional view showing the fluid injection nozzle of FIG. 7A taken along a line VIIC—VIIC in FIG. 7B.
Figure 8A:
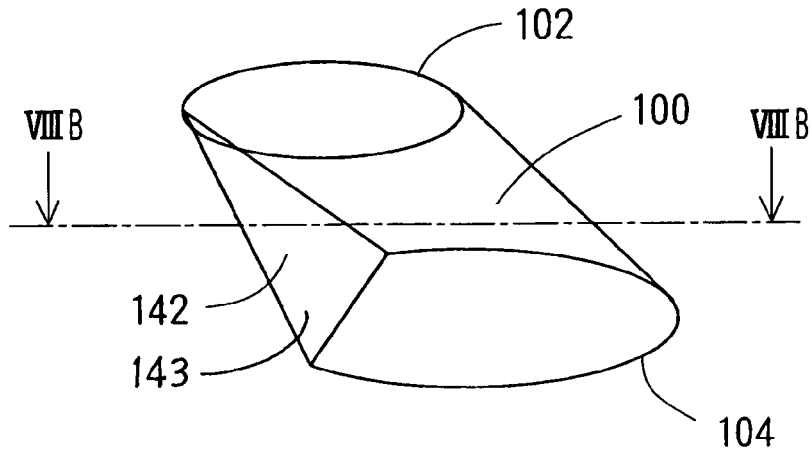
FIG. 8A is schematic perspective view of a fluid injection nozzle according to a third embodiment of the present invention.
Figure 8B:
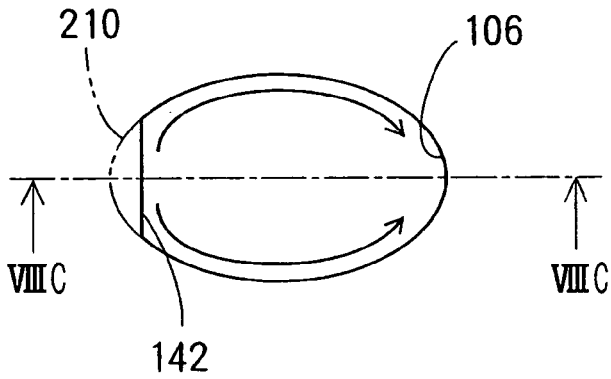
FIG. 8B is a cross-sectional view showing the fluid injection nozzle of FIG. 8A taken along a line VIIIB—VIIIB.
Figure 8C:
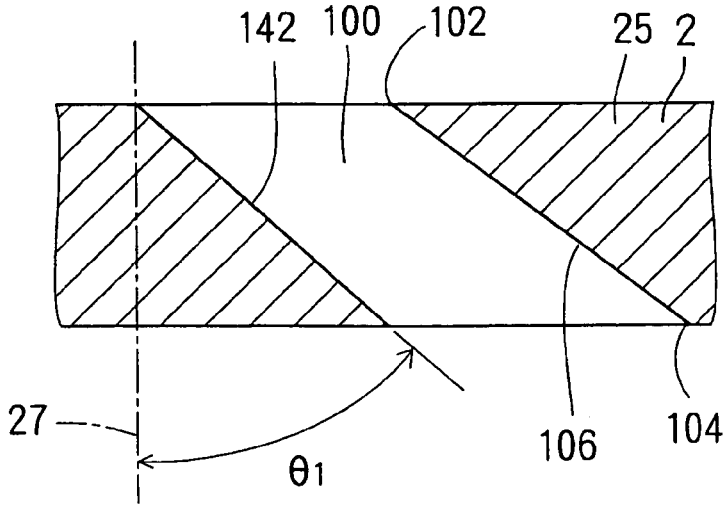
FIG. 8C is another cross-sectional view showing the fluid injection nozzle of FIG. 8A taken along a line VIIIC—VIIIC in FIG. 8B.
Figure 9A:
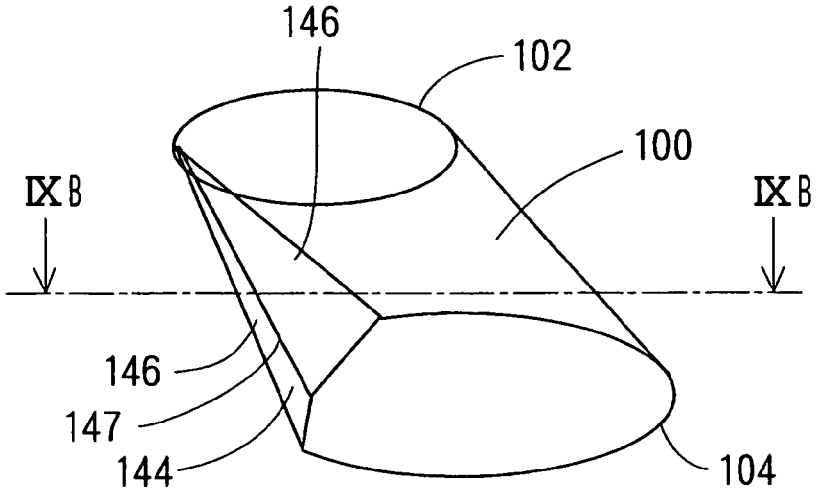
FIG. 9A is schematic perspective view of a fluid injection nozzle according to a fourth embodiment of the present invention.
Figure 9B:
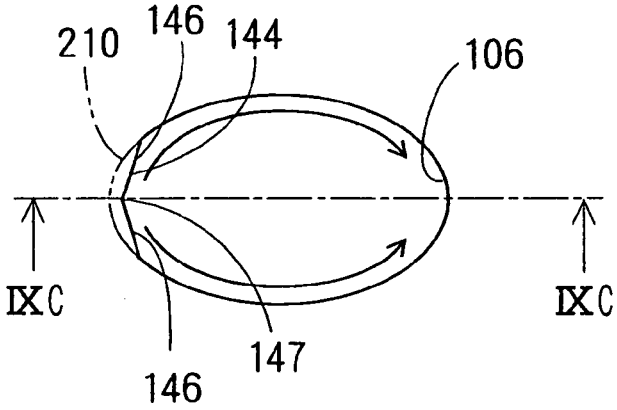
FIG. 9B is a cross-sectional view showing the fluid injection nozzle of FIG. 9A taken along a line IXB—IXB.
Figure 9C:
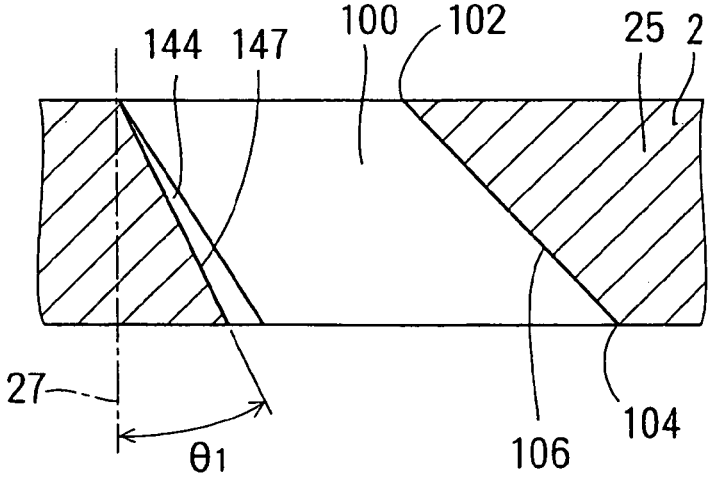
FIG. 9C is another cross-sectional view showing the fluid injection nozzle of FIG. 9A taken along a line IXC—IXC in FIG. 9B.

FIGS. 7A to 7C depict an injection port 100 according to a second embodiment of the present invention. FIGS. 8A to 8C depict an injection port 100 according to a third embodiment of the present invention. FIGS. 9A to 9C depict an injection port 100 according to a fourth embodiment of the present invention. Substantially the same components as those in the first embodiment will not especially described again and common referential numerals are assigned to them.

In the second and third embodiments, as shown in FIGS. 7A, 7B or FIGS. 8A, 8B, the injection port 100 is provided with a protruding portion 140 or 142 having one convex-shaped side face 141 or flat-shaped side face 143 instead of the protruding portion 110 having two side faces 112 in the first embodiment. In the fourth embodiment, the injection port 100 is provided with a protruding portion 144 having two side faces 146 arranged in a concaved manner as shown in FIGS. 9A, 9B.

In the second to fourth embodiments, each of the protruding portions 140, 142, 144 is disposed at the center axis 27-side of the inner surface 106. As shown in FIGS. 7C, 8C, 9C, the protruding portions 140, 142, 144 are inclined to the center axis 27 of the injection port plate 25 so as to extend radially outward from an inlet 102 to an outlet 104. As shown in FIGS. 7C, 10C, 11C, each of the side faces 141, 143 of the protruding portions 140, 142 and a thalweg line 147 between the two side faces 146 forms an angle θ1 to the center axis 27 so as to be $0° < \theta 1 < 90°$.

(Fifth and Sixth Embodiments)

Figure 10A:
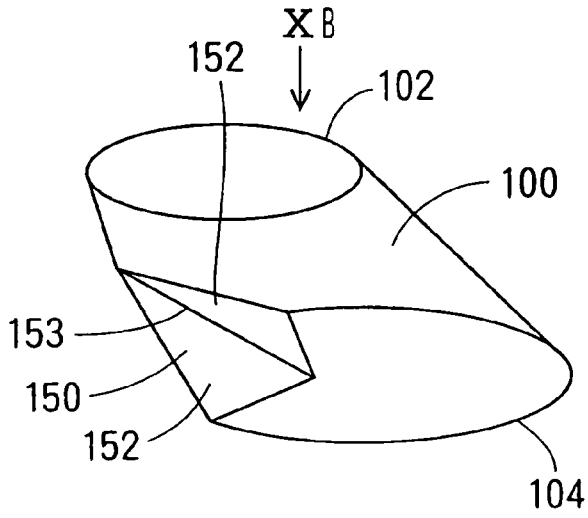
FIG. 10A is schematic perspective view of a fluid injection nozzle according to a fifth embodiment of the present invention.
Figure 10B:
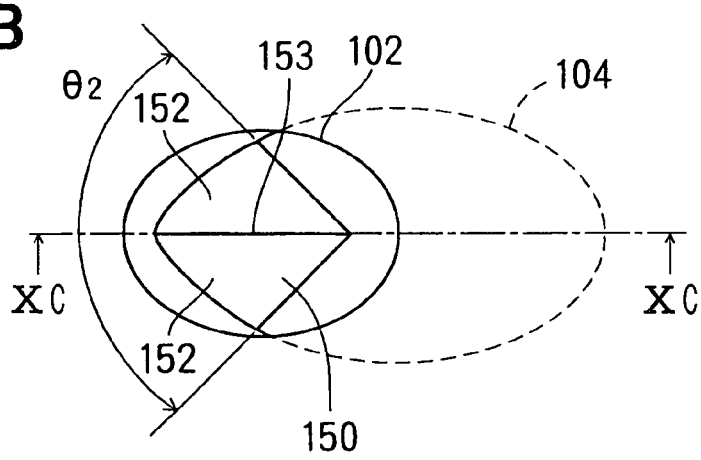
FIG. 10B is a cross-sectional view showing the fluid injection nozzle of FIG. 10A seen in a direction of an arrow XB.
Figure 10C:
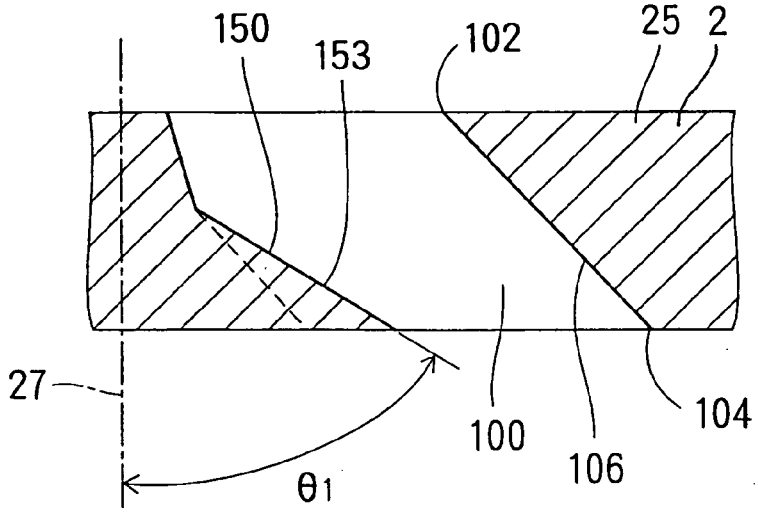
FIG. 10C is another cross-sectional view showing the fluid injection nozzle of FIG. 10A taken along a line XC—XC in FIG. 10B.
Figure 11A:
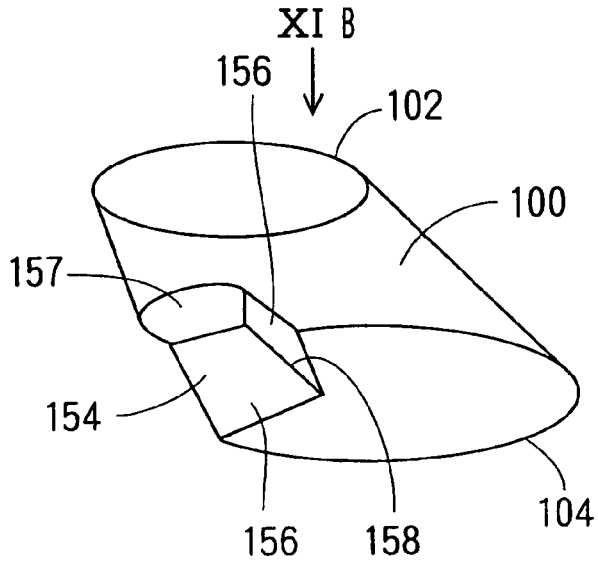
FIG. 11A is schematic perspective view of a fluid injection nozzle according to a sixth embodiment of the present invention.
Figure 11B:
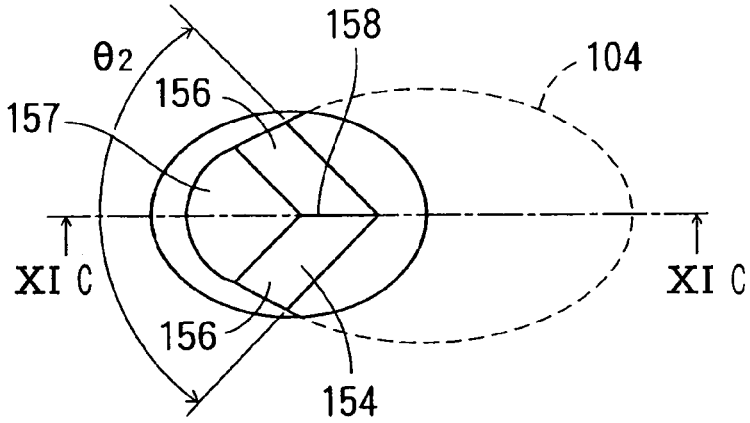
FIG. 11B is a cross-sectional view showing the fluid injection nozzle of FIG. 11A seen in a direction of an arrow XIB.
Figure 11C:
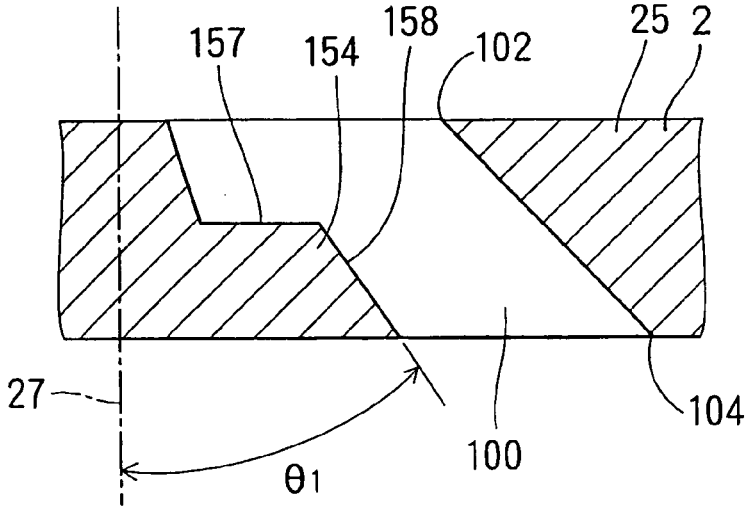
FIG. 11C is another cross-sectional view showing the fluid injection nozzle of FIG. 11A taken along a line XIC—XIC in FIG. 11B.

FIGS. 10A to 10C depict an injection port 100 according to a fifth embodiment of the present invention. FIGS. 11A to 11C depict an injection port 100 according to a sixth embodiment of the present invention. Substantially the same components as those in the first embodiment will not especially described again and common referential numerals are assigned to them.

In the first to fourth embodiments, the injection port 100 is provided with the protruding portion 110, 140, 142 or 144 extending over the entire depth of the injection port 100 from the inlet 102 to the outlet 104. In the fourth and sixth embodiments, the injection port 100 is provided with a protruding portion 150 or 154 extending from a middle depth portion of the injection port 100 to the outlet 104.

In the fifth embodiment shown in FIGS. 10A to 10C, the protruding portion 150 has two side faces 152.

In the sixth embodiment shown in FIGS. 11A to 11C, the protruding portion 154 has two side faces 156 and a top face 157 facing an inlet 102-side of the injection port 100.

As shown in FIGS. 10C, 11C, each of the ridge line 153 between the two side faces 152 and the ridge line 158 of the two side faces 156 forms an angle θ1 to the center axis 27 of the injection port plate 25 so as to be $0° < \theta 1 < 90°$. Further, as shown in FIG. 10B, the contour lines on the two side faces 153, which are perpendicular to the center axis 27, form an angle θ2 to each other so as to be $0° < \theta 2 < 180°$. As shown in FIG. 11B, the contour lines on the two side faces 156, which are perpendicular to the center axis 27, also form an angle θ2 to each other so as to be $0° < \theta 2 < 180°$.

In the sixth embodiment, the ridge line 158 of the protruding portion 154 may be disposed in parallel to the center axis 27. In this case, the angle θ1 is regarded as being formed by the top face 157 and the center axis 27, so as to be $\theta 1 = 90°$. The present invention includes 90° in a range of angle θ1 that the protruding portion and the center axis form to each other.

(Seventh Embodiment)

Figure 12A:
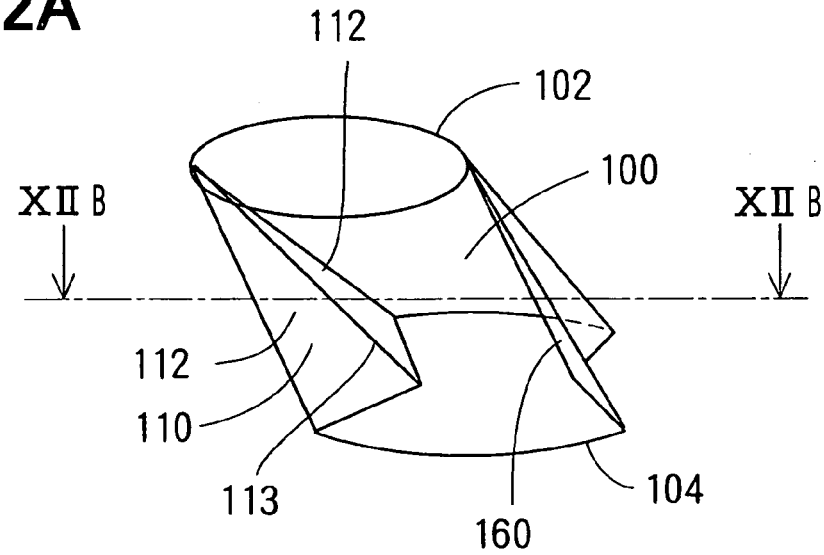
FIG. 12A is schematic perspective view of a fluid injection nozzle according to a seventh embodiment of the present invention.
Figure 12B:
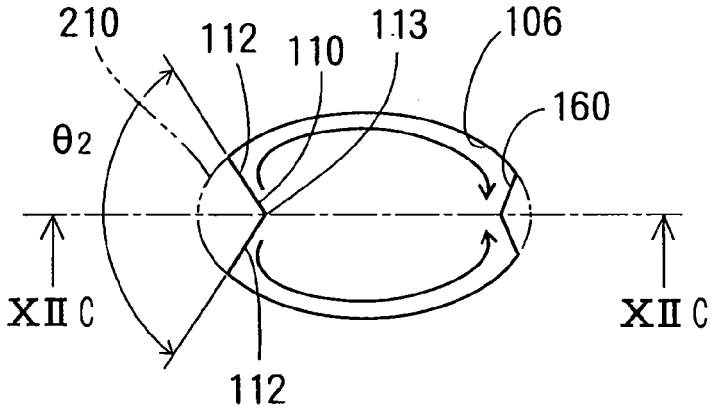
FIG. 12B is a cross-sectional view showing the fluid injection nozzle of FIG. 12A taken along a line XIIB—XIIB.
Figure 12C:
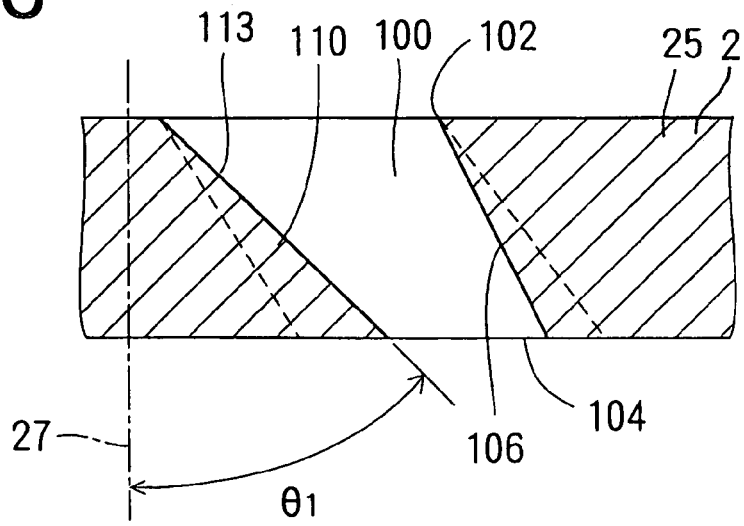
FIG. 12C is another cross-sectional view showing the fluid injection nozzle of FIG. 12A taken along a line XIIC—XIIC in FIG. 12B.

FIGS. 12A to 12C depict an injection port 100 according to a seventh embodiment of the present invention. Substantially the same components as those in the first embodiment will not especially described again and common referential numerals are assigned to them.

In the seventh embodiment, the injection port 100 is provided with a convex-shaped protruding portion 160 on the inner surface 106 to face the protruding portion 110 at the center axis 27-side.

When the protruding portion 110 changes the flow direction of fuel along the inner surface 106, the fuel may collide at a counter protruding portion 110-side of the inner surface 106 to flocculate. Thus, in the seventh embodiment, the second protruding portion 160 formed to face the protruding portion 110 restricts fuel colliding thereat. Thus, it is possible to prevent fuel to flocculate to be a non-dispersed injection.

(Eighth Embodiment)

Figure 13A:
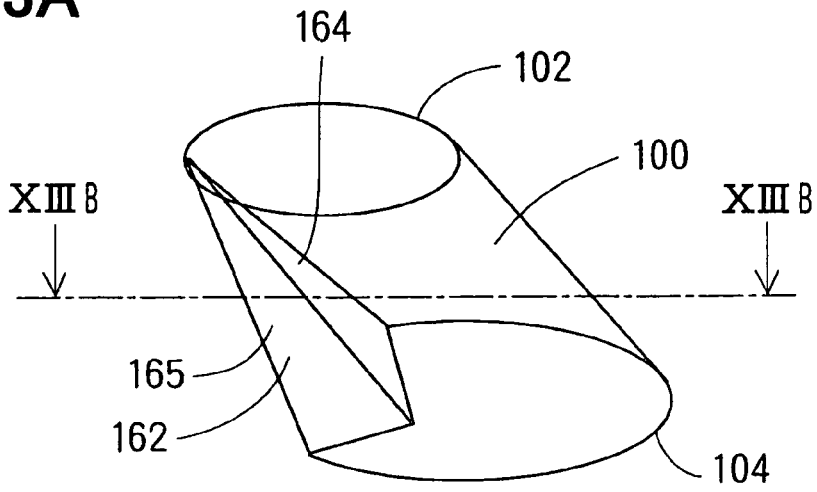
FIG. 13A is schematic perspective view of a fluid injection nozzle according to an eighth embodiment of the present invention.
Figure 13B:
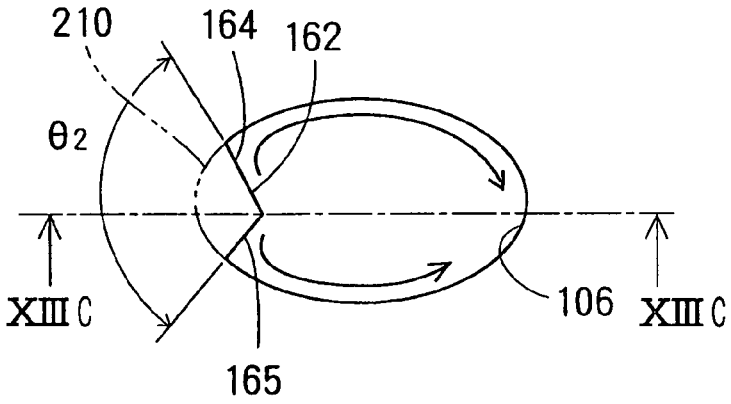
FIG. 13B is a cross-sectional view showing the fluid injection nozzle of FIG. 13A taken along a line XIIIB—XIIIB.
Figure 13C:
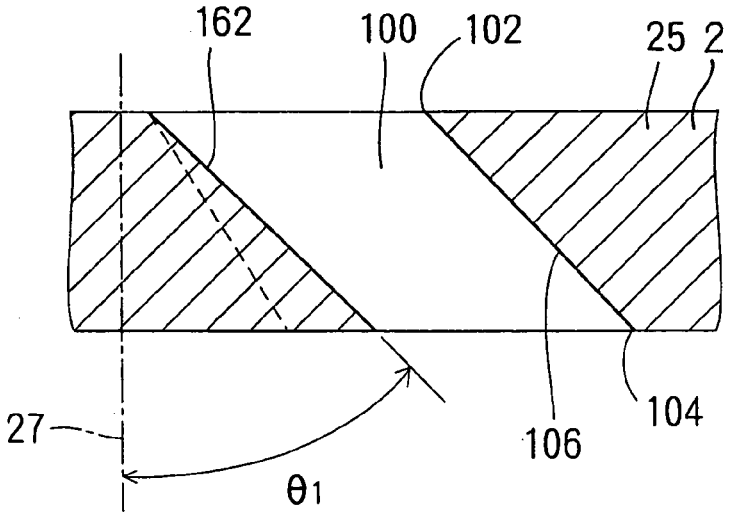
FIG. 13C is another cross-sectional view showing the fluid injection nozzle of FIG. 13A taken along a line XIIIC—XIIIC in FIG. 13B.

FIGS. 13A to 13C depict an injection port 100 according to an eighth embodiment of the present invention. Substantially the same components as those in the first embodiment will not especially described again and common referential numerals are assigned to them.

In the eighth embodiment, as shown in FIG. 13B, the injection port 100 is provided with a protruding portion 162 having flat-shaped large and small side faces 164, 165. The large side face 164 has an area larger than that of the small side face 165. The large side face 164 urges fuel to a large side face 164-side of the inner surface 106 more than the small side face 165 urges fuel to a small side face 165-side of the inner surface 106. Thus, the fuel sprayed out of the injection port 100 is inclined to the small side face-165 side of the inner surface 106. Thus, a direction of the fuel sprayed out of the injection port 100 can be modified by adjusting the ratio of areas of the large and small side faces 164,165. Accordingly, it is possible to adjust a dispersion angle of fuel sprayed out of a plurality of the injection ports 100.

(Ninth, Tenth and Eleventh Embodiments)

Figure 14A:
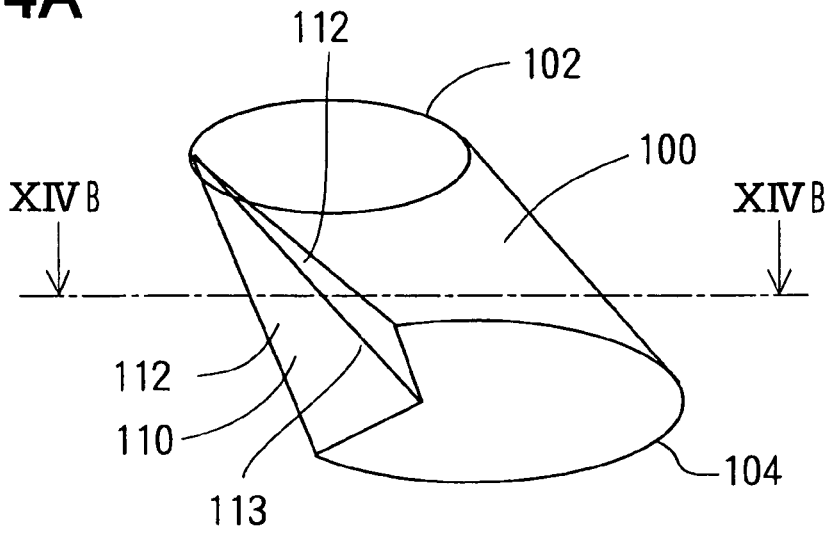
FIG. 14A is schematic perspective view of a fluid injection nozzle according to a ninth embodiment of the present invention.
Figure 14B:
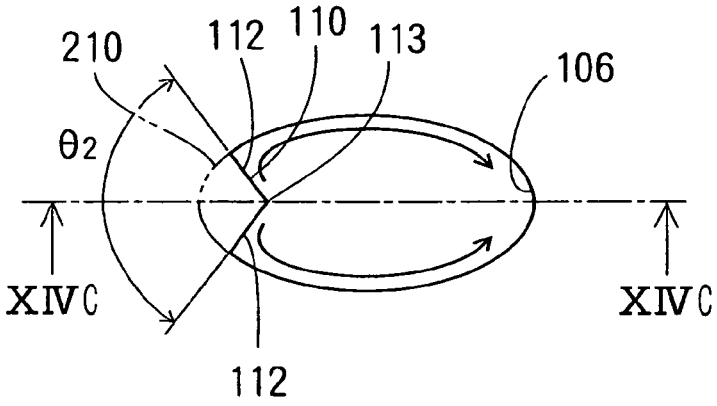
FIG. 14B is a cross-sectional view showing the fluid injection nozzle of FIG. 14A taken along a line XIVB—XIVB.
Figure 14C:
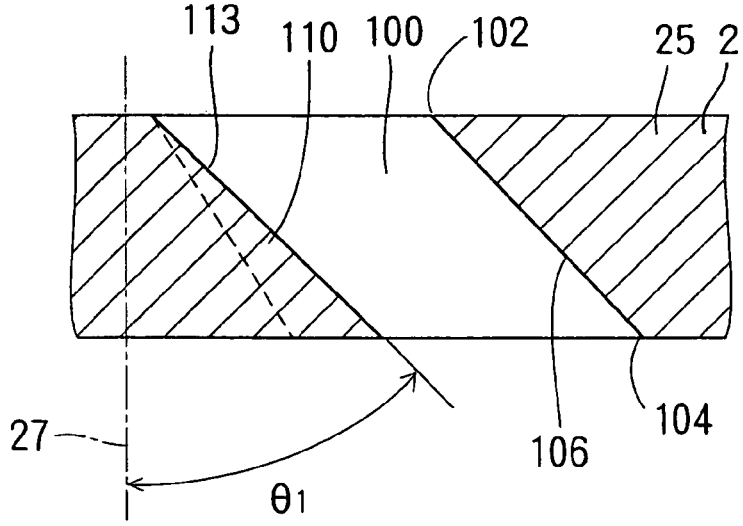
FIG. 14C is another cross-sectional view showing the fluid injection nozzle of FIG. 14A taken along a line XIVC—XIVC in FIG. 14B.
Figure 15A:
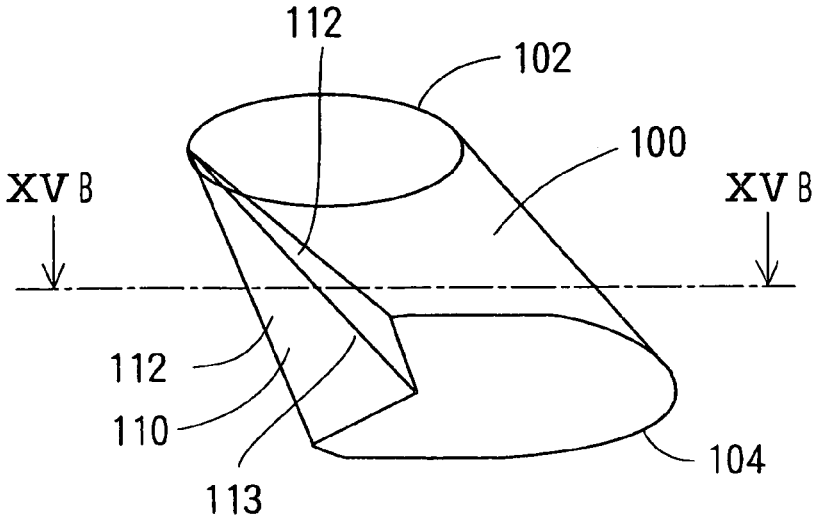
FIG. 15A is schematic perspective view of a fluid injection nozzle according to a tenth embodiment of the present invention.
Figure 15B:
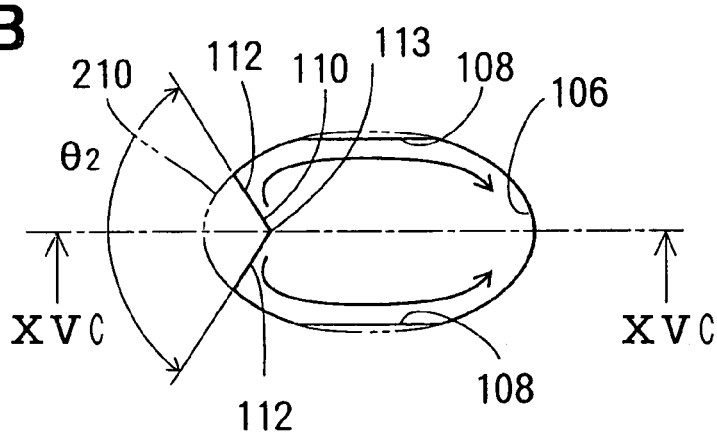
FIG. 15B is a cross-sectional view showing the fluid injection nozzle of FIG. 15A taken along a line XVB—XVB.
Figure 15C:
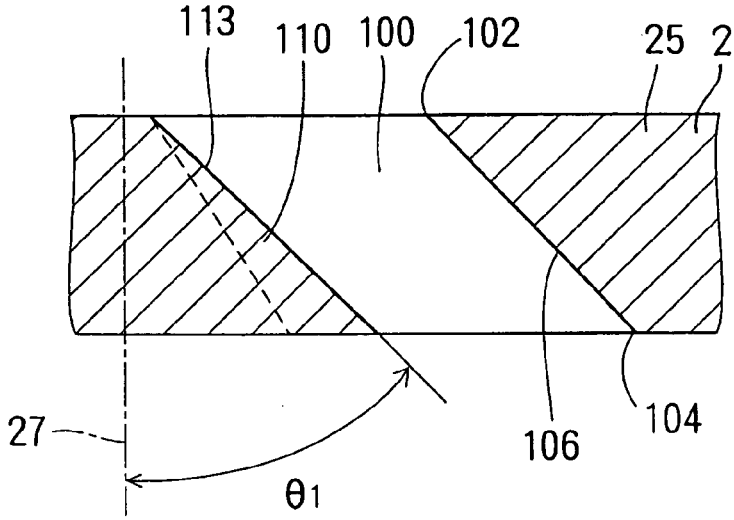
FIG. 15C is another cross-sectional view showing the fluid injection nozzle of FIG. 15A taken along a line XVC—XVC in FIG. 15B.

FIGS. 14A to 14C depict an injection port 100 according to a ninth embodiment of the present invention. FIGS. 15A to 15C depict an injection port 100 according to a tenth embodiment of the present invention. FIGS. 14A to 14C depict an injection port 100 according to an eleventh embodiment of the present invention. Substantially the same components as those in the first embodiment will not especially described again and common referential numerals are assigned to them.

In the ninth embodiment shown in FIGS. 14A to 14C, the injection port 100 has a cross-section of an inner surface 106 with a larger oblateness than that of the injection port 100 in the first embodiment. The large oblateness of the injection port 100 decreases a spray angle of fuel sprayed out of the injection port 100 in the direction of a minor axis of the imaginary circle 210. Accordingly, it is possible to adjust a dispersion angle of fuel sprayed out of a plurality of the injection ports 100.

In the tenth embodiment shown in FIGS. 15A to 15C, the injection port 100 has an inner surface 106 having a pair of flat faces 108 in addition to the protruding portion 110. The flat faces 108 are disposed both sides of the inner surface 106 to face each other in a direction of a minor axis of the elliptical-shaped imaginary circle 210. The flat faces 108 occupy larger percentage of the inner surface 106 as going from an inlet 102 to an outlet 104 of the injection port 100. That is, as going from the inlet 102 to the outlet 104, the flat faces 108 protrude inside the imaginary circle 210 further so as to make the injection port 100 more oblate. Thus, a spray angle of fuel sprayed out of the injection port 100 is decreased in the direction of the minor axis of the imaginary circle 210. Accordingly, it is possible to adjust a dispersion angle of fuel sprayed out of a plurality of the injection ports 100.

Figure 16A:
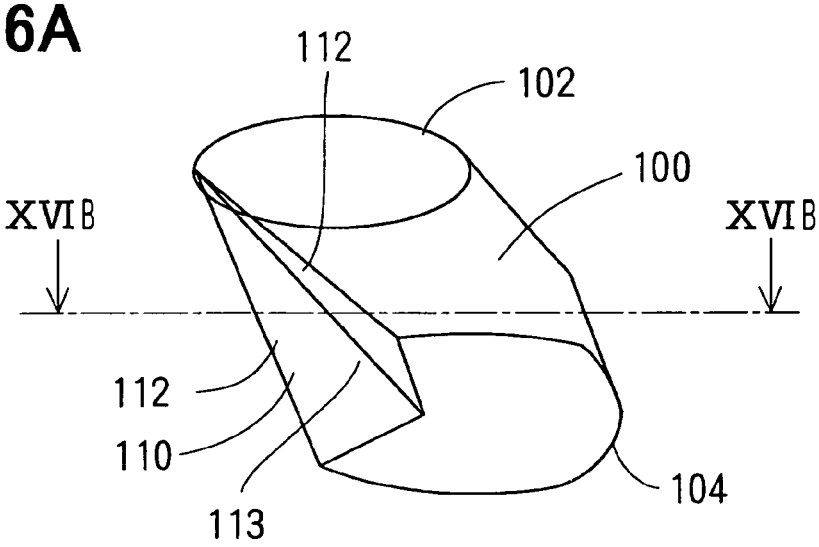
FIG. 16A is schematic perspective view of a fluid injection nozzle according to an eleventh embodiment of the present invention.
Figure 16B:
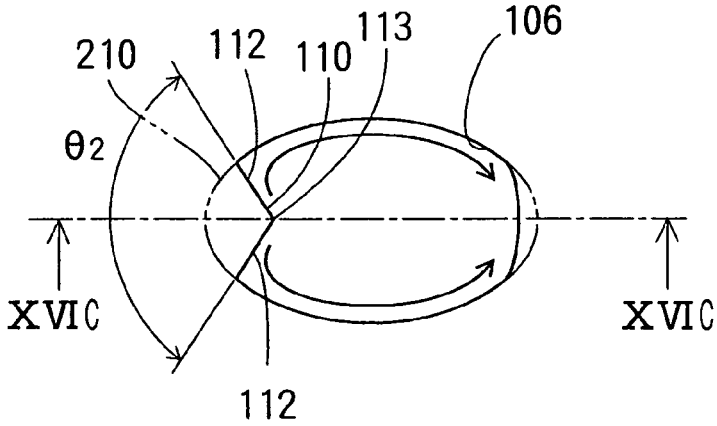
FIG. 16B is a cross-sectional view showing the fluid injection nozzle of FIG. 16A taken along a line XVIB—XVIB.
Figure 16C:
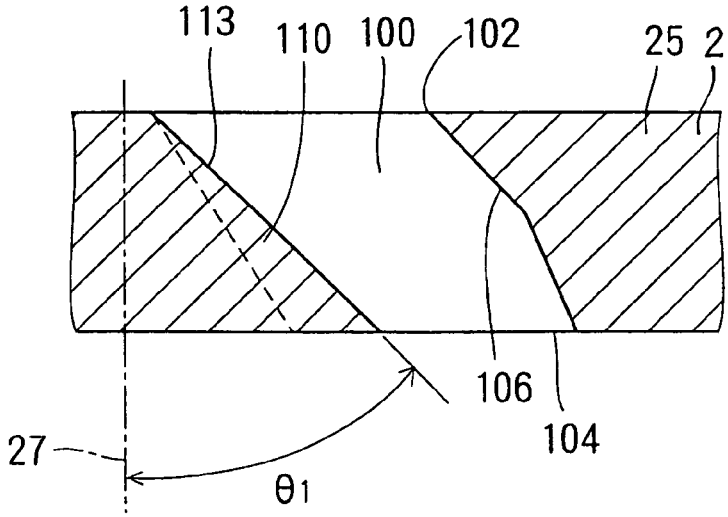
FIG. 16C is another cross-sectional view showing the fluid injection nozzle of FIG. 16A taken along a line XVIC—XVIC in FIG. 16B.

In the eleventh embodiment shown in FIGS. 16A to 16C, the injection port 100 has an inner surface 106 so formed that a counter protruding portion-110 side protrudes inward as going from the inlet 102 to the outlet 104. That is, as going from the inlet 102 to the outlet 104 of the injection port 100, the counter protruding portion 11 0-side of the inner surface 106 protrudes inside an elliptical-shaped imaginary circle 210 further so as to shorten a diameter of the injection port 100 in a direction of a major axis of the imaginary circle 210. Thus, a spray angle of fuel sprayed out of the injection port 100 is decreased in the direction of the major axis of the imaginary circle 210. Accordingly, it is possible to adjust a dispersion angle of fuel sprayed out of a plurality of the injection ports 100.

(Twelfth Embodiment)

Figure 17A:
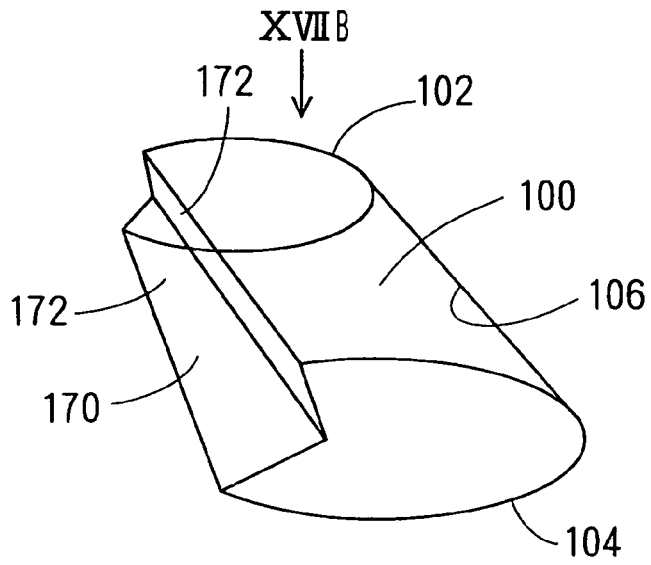
FIG. 17A is schematic perspective view of a fluid injection nozzle according to a twelfth embodiment of the present invention.
Figure 17B:
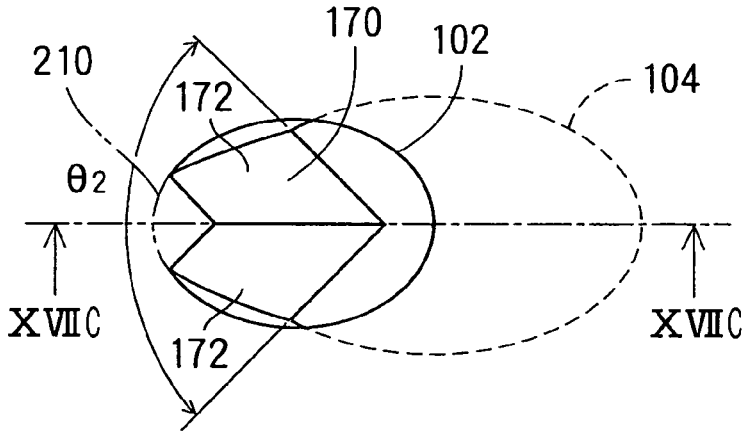
FIG. 17B is a cross-sectional view showing the fluid injection nozzle of FIG. 17A seen in a direction of an arrow XVIIB.
Figure 17C:
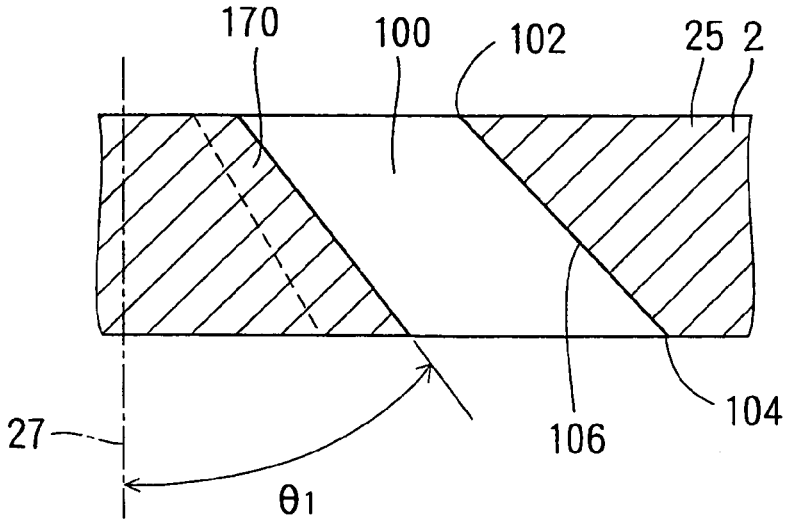
FIG. 17C is another cross-sectional view showing the fluid injection nozzle of FIG. 17A taken along a line XVIIC—XVIIC in FIG. 17B.

FIGS. 17A to 17C depict an injection port 100 according to a twelfth embodiment of the present invention. Substantially the same components as those in the first embodiment will not especially described again and common referential numerals are assigned to them.

In the twelfth embodiment, the injection port 100 is provided with a protruding portion 170 having two side faces 172 protruding inside an imaginary circle 210 over entire length of the injection port 100 from the inlet 102 to the outlet 104.

(Thirteenth Embodiment)

Figure 18A:
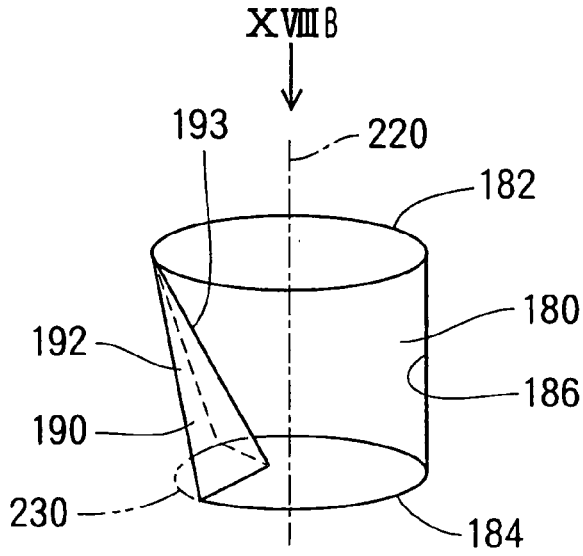
FIG. 18A is schematic perspective view of a fluid injection nozzle according to a thirteenth embodiment of the present invention.
Figure 18B:
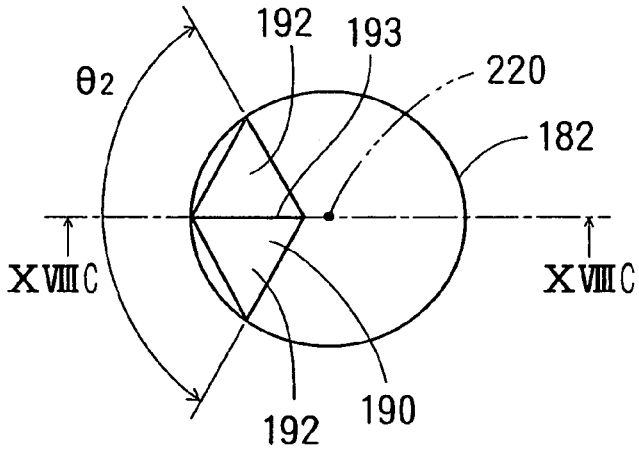
FIG. 18B is a cross-sectional view showing the fluid injection nozzle of FIG. 18A seen in a direction of an arrow XVIIIB.
Figure 18C:
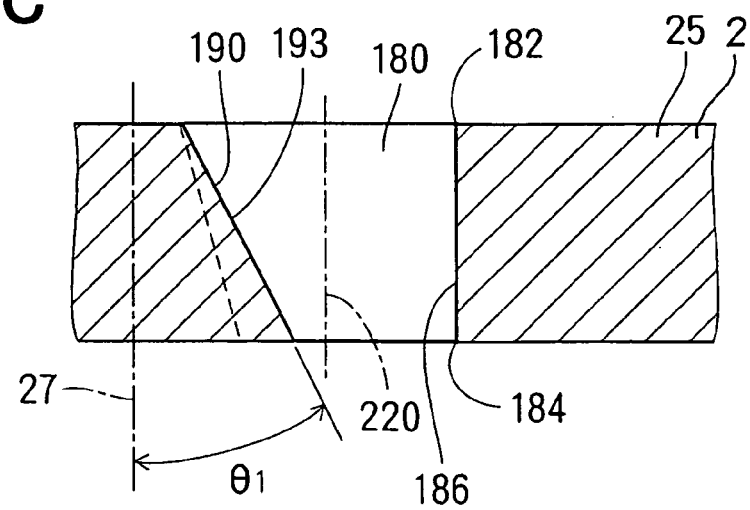
FIG. 18C is another cross-sectional view showing the fluid injection nozzle of FIG. 18A taken along a line XVIIIC—XVIIIC in FIG. 18B.

FIGS. 18A to 18C depict an injection port plate 25 according to a thirteenth embodiment of the present invention. Substantially the same components as those in the first embodiment will not especially described again and common referential numerals are assigned to them.

In each the above-described embodiments, the injection port 100 is inclined to the center axis 27 so as to extend away from the center axis 27 as going from the inlet 102 to the outlet 104. Contrastively in the thirteenth embodiment, the injection port 180 extends substantially in parallel to the center axis 27 of the injection port plate 25. The injection port 180 has an inner surface 186 provided with a protruding portion 190. The protruding portion 190 is disposed at the center axis 27-side of the inner surface 186 and protrudes inward in the injection port 180.

As shown in FIG. 18B, the protruding portion 190 has two flat-shaped side faces 192. Seeing in a direction of the center axis 27, the side faces 192 form an angle $\theta 2$ with each other to satisfy a relation of $0° < \theta 2 < 180°$. That is, the protruding portion 190 protrudes radially inward in the injection port 180. The side face 192 becomes wider as going from an inlet 182 to an outlet 184 of the injection port 180. The injection port 180 has a perfectly circle-shaped cross-section at the inlet 182. Except for the cross-sectional position at the inlet, the inner surface 186 except the protruding portion 190 is on an imaginary circle 230 that coincides with the inlet 182 when seen in a direction in parallel to the center axis 27. As described above, the injection port 180 penetrates the injection port plate 25 approximately in parallel to the center axis 27. That is, in the thirteenth embodiment, the injection port 180 has an center axis 220 parallel to the center axis 27 of the injection port plate 25. Thus, a diameter d of the injection port 180 is determined equal to a diameter of inlet 182. The protruding portion 190 protrudes radially inside the imaginary circle 230. As shown in FIG. 18C, a ridge line 193 between the two side faces 192 forms an angle $\theta 1$ with respect to the center axis 27 to satisfy a relation of $0° < \theta 1 < 90°$.

(Fourteenth Embodiment)

Figure 19:
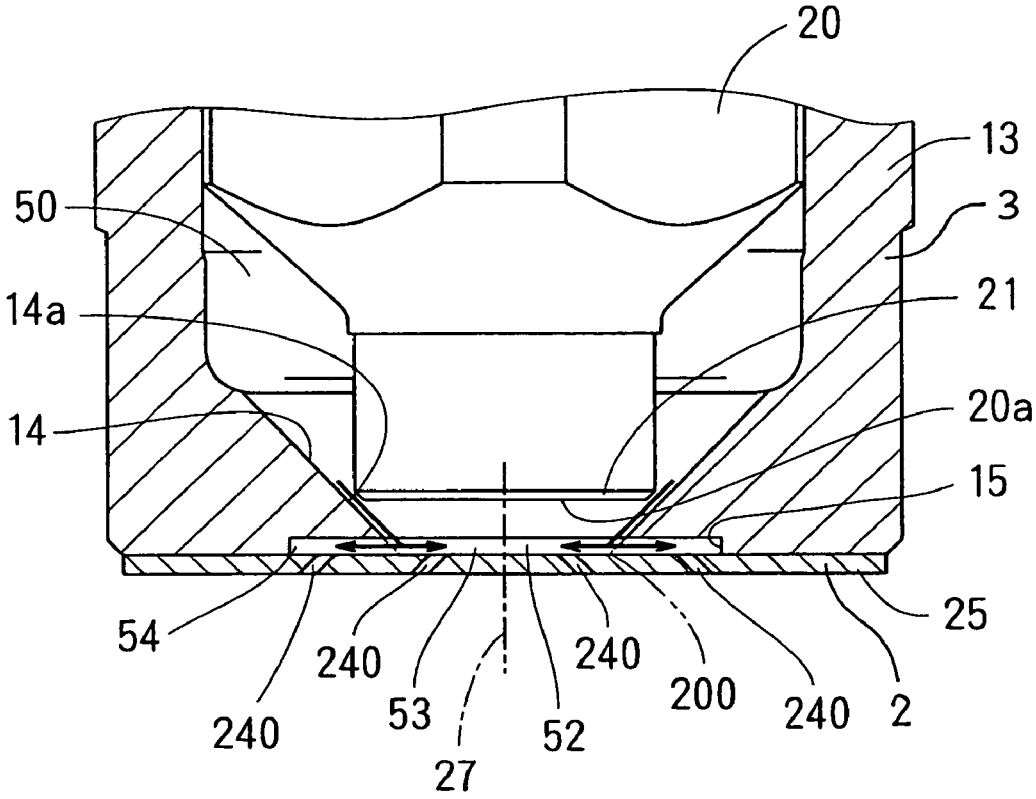
FIG. 19 is an enlarged cross-sectional view showing a nozzle portion of a fuel injector having a fuel injection nozzle according to the fourteenth embodiment.

FIG. 19 depicts an injection port plate 25 according to a fourteenth embodiment of the present invention and its surrounding portions. Substantially the same components as those in the first embodiment will not especially described again and common referential numerals are assigned to them.

In the fourteenth embodiment, as shown in FIG. 19, the valve body 13 is provided with a depressed portion 15 at a fuel injection side end thereof. The depressed portion 15 and the injection port plate 25 forms a fuel chamber 52 therebetween having flat disc shape. The fuel chamber 52 is communicated to the fuel passage at a fuel upstream side. The fuel chamber 52 has a diameter larger than a diameter of a lower end opening formed by the inner surface 14. An extension plane of the inner surface 14 divides the fuel chamber 52 into a center chamber 53 and a peripheral chamber 54. Each of the center and peripheral chambers 53, 54 is provided with injection ports 240. The injection ports 240 are formed as any one or more shape(s) described in the above-described embodiments. The injection ports 240 are provided with the protruding portions at the center axis 27-side where the fluid flow contracts.

In the above described embodiments, the protruding portions promote the fuel to be film-shaped flow to be dispersed and atomized.

(Other Embodiments)

In the first embodiment, as shown in FIGS. 4A to 4C, 5A to 5C and 6A to 6E, the injection port 100 is formed by punch press process. The injection port 100 can be formed also by electric discharge machining with the electrode having substantially same shape as shown in the figures.

In the above-described embodiments, the protruding portions are disposed at the center axis 27-side in the injection port 100. The protruding portions may be disposed on other positions in the injection port such as the counter center axis 27-side.

The inner surface of the injection port may be formed in a polygonal shape other than perfect circle and elliptic cross-section.

In the above-described embodiments, the fuel injection valve according to the present invention is used as fuel injection valve incorporated in the gasoline engine. The fuel injection valve according to the present invention can be applied to any kinds of injectors for injecting liquid to be atomized.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fluid injection nozzle comprising:

an injection port plate having a center axis perpendicularly intersecting a central portion of a plate surface thereof and being mounted on a downstream end of a fluid injection valve so that the center axis of the injection port plate is coaxial to a center axis of the fluid injection valve;

an injection port penetrating the injection port plate between an inlet and an outlet; and a protruding portion protruding from an inner surface of the injection port, towards a portion in the interior of the outlet, to shift a direction of at least a part of a fluid flow passing through the injection port to flow in a circumferential direction of the inner surface, the protruding portion including at least one generally flat surface.

2. The fluid injection nozzle according to claim 1, wherein:

a cross-section of the inner surface taken in a plane perpendicular to said center axis of the injection port plate is on a perfect or oval circle-shaped imaginary line; and a cross-section of the protruding portion is disposed inside the imaginary line.

3. The fluid injection nozzle according to claim 1, wherein the protruding portion is disposed at a side in the injection port where the fluid flow contracts.

4. The fluid injection nozzle according to claim 1, wherein the injection port extends from the inlet to the outlet thereof in a direction away from the center axis of the injection port plate.

5. The fluid injection nozzle according to claim 1, wherein the injection port is shaped so that a cross-sectional area taken in a plane perpendicular to said center axis of the injection port plate gradually increases as it comes closer to the outlet.

6. The fluid injection nozzle according to claim 4, wherein the protruding portion is disposed on the injection hole plate center axis side of the injection port.

7. The fluid injection nozzle according to claim 1, wherein the protruding portion has a side face thereon which extends to recede from a center axis of the injection port plate with as it comes closer to the outlet; and the side face is inclined to the center axis by an angle $\theta 1$ satisfying a relation of $0° < \theta 1 \leqq 90°$.

8. The fluid injection nozzle according to claim 1, wherein:

a cross-section of the inner surface taken in a plane perpendicular to said center axis of the injection hole plate is on an oval circle-shaped imaginary line;

a cross-section of the protruding portion is disposed inside the imaginary line; and a thickness t of the injection port plate and an inlet width d of the inlet of the injection port satisfy a relation of $0.4 \leqq t/d \leqq 1.4$ the inlet width d being a minimum distance in a vertical plane including a major axis of the oval-shaped imaginary line, from the inner surface of the injection port covered with the protruding portion to an opposite opening periphery of the inlet of the injection port.

9. A fuel injector comprising:

the fluid injection nozzle according to claim 1;

a valve body portion which is mounted on an upstream end of the fluid injection nozzle and provided with a conical inner surface converged toward the fluid injection nozzle; and a nozzle needle which seats on and lifts off a valve seat provided on the inner surface of the fluid injection nozzle to start and stop a fuel injection through the injection port.

10. A fluid injection nozzle comprising:

an injection port plate having a center axis perpendicularly intersecting a central portion of a plate surface thereof and being mounted on a downstream end of a generally cylindrical fluid injection valve so that the center axis thereof is coaxial to a central axis of the fluid injection valve;

an injection port penetrating the injection port plate between an inlet and an outlet; and a protruding portion protruding from an inner surface of the injection port, towards a portion in the interior of the outlet, to shift a direction of at least a part of a fluid flow passing through the injection port to flow in a circumferential direction of the inner surface, wherein:

the protruding portion has two flat faces which are arranged thereon and abreast with each other in the circumferential direction of the inner surface; and the two flat faces form an angle $\theta 2$ with each other to satisfy a relation of $0° < \theta 2 \leqq 180°$.

* * * * *

UNITED STATES PATENT AND TRADEMARK OFFICE

CERTIFICATE OF CORRECTION

PATENT NO. : 7,159,802 B2
APPLICATION NO. : 11/195609
DATED : January 9, 2007
INVENTOR(S) : Oomura et al.

It is certified that error appears in the above-identified patent and that said Letters Patent is hereby corrected as shown below:

On the Title Page;

Item
"(75) Inventors: Hidekazu Oomura, Hekinan (JP); Yoshinori Yamashita, Kariya (JP); Yukio Tomiita, Anjo (JP); Yukio Sawada, Kariya (JP); Ryo Nagasaka, Nagoya (JP)"

should be

Item
--(75) Inventors: Hidekazu Oomura, Hekinan (JP); Yoshinori Yamashita, Kariya (JP); Yukio Tomiita, Anjo (JP); Yukio Sawada, Anjo (JP); Ryo Nagasaka, Nagoya (JP)--.

Signed and Sealed this

Twenty-seventh Day of March, 2007

JON W. DUDAS
*Director of the United States Patent and Trademark Office*